US005791821A

United States Patent [19]

Kiesler

[11] Patent Number: 5,791,821

[45] Date of Patent: Aug. 11, 1998

[54] SHAPED-CHARGE CUTTING DEVICE FOR PILES AND UNDERWATER TUBULAR MEMBERS

[76] Inventor: James E. Kiesler, 1029 Fig St., Morgan City, La. 70380

[21] Appl. No.: 812,874

[22] Filed: Mar. 6, 1997

[51] Int. Cl.[6] ..... E02D 9/04; E02D 5/32

[52] U.S. Cl. ..... 405/232; 102/309; 102/312; 166/55.7; 405/227

[58] Field of Search ..... 405/227, 232, 405/195.1, 253; 166/54.6, 55.6, 55, 297, 55.7; 299/13; 175/4.6; 102/312, 313, 319, 315, 309

[56] References Cited

U.S. PATENT DOCUMENTS

| | | | |
|---|---|---|---|
| 2,939,532 | 6/1960 | Morriss | 166/55 X |
| 3,036,522 | 5/1962 | Lindsey | 166/54.6 |
| 4,378,844 | 4/1983 | Parrish et al. | 166/297 |
| 4,619,556 | 10/1986 | Parra | 405/227 X |
| 4,799,829 | 1/1989 | Kenny | 405/232 X |
| 5,046,563 | 9/1991 | Engel et al. | 166/297 |
| 5,513,570 | 5/1996 | Mulcahy | 299/13 X |

*Primary Examiner*—Dennis L. Taylor
*Attorney, Agent, or Firm*—Keaty & Keaty

[57] ABSTRACT

The invention relates to a device for severing tubular members, such as piles of an offshore platform. The device is incorporated into a platform pile as one of the sections of the pile and is deployed below a mudline during installation of the pile. A shaped charge mounted in that section remains unloaded during the useful life of the platform. An explosive material is delivered into the shaped charge through conduits immediately prior to severing the pile when the platform needs to be removed.

15 Claims, 1 Drawing Sheet

SHAPED-CHARGE CUTTING DEVICE FOR PILES AND UNDERWATER TUBULAR MEMBERS

BACKGROUND OF THE INVENTION

This present invention relates to explosive technology, and more particularly to an explosive cutter for tubular piles and other tubular structures underwater. The majority of offshore platforms that support drilling and production of oil and gas operations are secured to the sea floor with steel tubular piles driven into the soil to a sufficient depth to withstand the environmental forces acting on the structures, such as wind, waves and current. The support piles are also designed to withstand operating loads of a drilling or production equipment, living quarters of servicing personnel positioned on the platform above the sea level, and other associated loads.

The piles can range from twelve inches to over ten feet in diameter, with the thickness of the walls ranging from ⅜" to over 3½" below the mudline, where the greatest load is applied. The number of piles that are needed to support a platform varies from one in a single or multi-well caisson in shallow waters to 16–32 in larger platforms adapted for deep water drilling and production.

Generally, the piles are driven through a steel jacket that provides lateral support for the piles. A small portion of the jacket usually extends above the water. The platform deck rests upon and is secured to the supporting piles.

During recent years, the number of platforms removed from production sites has drastically increased. The removal of platforms is governed by strict federal regulations, the general requirement being that the piles are to be cut to at least 15 feet below the natural mudline. The removal methods range from mechanical devices, such as mechanical or abrasive cutters, divers cuts to explosive means. The non-explosive means, such as mechanical cutters or abrasive cutters, and severing formed by divers usually do not require compliance with various regulations imposed on explosive methods for removing the platform. All existing methods for internal cuts require evacuating the soil from inside the piles. All existing methods for external cuts require the soil to be evacuation from around the outside.

When the severing is performed by a mechanical cutting tool, the tool is lowered into the pile, turned by a power swivel or downhole motor, while hydraulically actuated blades expand to cut the pile at a pre-determined location. The cutting process is relatively expensive and is not entirely reliable. Worn or broken blades may require frequent trips out of and into the pile. Returning to the same location where the cutting was initiated may become difficult. Additionally, the platform deck itself has to be disengaged from the piles and removed to allow access to the open pile top and support for the actuary blade cutting device.

Abrasive cutters also are lowered inside the pile, where high pressure water with abrasive, such as sand or slag entrenched in the slurry, is forced from a narrow nozzle to abrasively wear away the steel pile. This type of tool, similarly to the mechanical cutter, requires access through the top of the open pile or through windows that have been cut into the side of the jacket or deck leg. Prior to application of the abrasive cutter, mud and other debris must be evacuated from the pile to allow a stand-off distance between the injection nozzle and the target area. The abrasive cutters are relatively complicated, they require support equipment which makes the method relatively expensive in comparison with the cost of explosive cutting.

When divers perform the cut underwater, they use jamming rods after an evacuation of soil from the pile has been performed. If the cut is made from the inside of the pile, oxygen and hydrogen build up in the mud on the outside of the pile can cause explosion if the gases have not been properly vented. If the cut is performed on the outside of the pile, the soil surrounding the pile must be evacuated down at the location where the cut is to be performed. Such evacuation of soil poses a threat of a cave in and other safety problems.

The least expensive and most reliable of the severing methods currently used in the removal of offshore platforms utilizes bulk explosives. This method is generally simple, reliable, can be adapted to varying soil conditions and has historically demonstrated better safety records than other methods. When bulk explosive charges are employed, the explosive composition is deployed in the open pile after the mud has been jetted out to the proper depth. Pre-packaged explosives are lowered into the pile, the detonator is connected, and detonation performed at the surface carries a signal to the bulk explosive location, severing the pile at that level. One of the disadvantages of using bulk explosive charges is that it creates deformation of the pile at the cut location which might make it difficult to pull the pile through the jacket leg. Additionally, if the piles are locked in the jacket by grouting, the irregular or jagged ends must be trimmed in order to fit the jacket on a cargo barge for transportation.

Shaped-charges, in comparison to bulk explosive charges, use a relatively small amount of explosive that is positioned in a shaped-charge case to cause acceleration of the liner in forming of a cutting jet at the target level.

One of the advantages of using shaped charges is their ability to form a relatively smooth cut, leaving no belling or deformation of the pile. It is important, when using an explosive shaped-charge, to form a proper stand-off distance, that is the distance from the closest part of the liner to the target area of the pile surface. For this purpose, the soil must be evacuated from the inside of the pile to allow lowering of the shaped charge to the target location. Usually, the housing that carries the shaped charge is equipped with fold up centralizers which are extended once the shaped charge is lowered to the desired distance. Often an inflatable packer is used to form a watertight seal between the interior of the pile and the explosive charge liner.

When the explosive device is lowered with a running tool, the tool must be designed to manipulate the charge to the proper depth, expand the charge, place it in the proper orientation, expand the packer, and disconnect from the charge before being removed from the pile. When the device is deployed by divers, hazardous conditions are created, since a diver has to move within a confined space of a small diameter pile.

These attempts using field-deployed shaped-charges have been generally unsatisfactory and failures were attributed to poor stand-off distance control, water infiltration, misalignment, and improper fit.

The present invention contemplates elimination of drawbacks associated with prior devices and provision of a shaped charge explosive device that would be efficient in operation and could perform pile severing functions using a low weight charge.

SUMMARY OF THE INVENTION

It is, therefore, an object of the present invention to provide a device for severing tubular members, such as piles of an offshore platform at below-the-mudline level, or other tubular members at any level in or out of the water column.

It is another object of the present invention to provide a shaped charge explosive device that would allow control of the stand-off distance between an interior or exterior of the tubular member and the liner of the shaped-charge.

It is a further object of the present invention to provide a device for severing tubular members that results in a relatively smooth, even cut.

A still further object of the present invention is to provide a shaped charge explosive device that can be used for severing various diameter tubular members with consistent predicable results.

These and other objects of the present invention are achieved through a provision of an apparatus for severing tubular members. The apparatus comprises a cylindrical body which is adapted to form one section of the tubular member when the tubular member is assembled and deployed in a desired location. The section containing the severing apparatus is installed in the platform structure at a predetermined location. In the case of a pile severing device, the apparatus is installed at a predetermined depth below the mudline. The apparatus comprises a cylindrical body, an annular shaped-charge housing fixedly attached to an interior or an exterior wall of the cylindrical body, a charge case and liner, and a means for delivering an explosive material to the charge case.

The hollow shaped charge case is fixedly secured on the inner wall of the housing within an interior chamber formed by the housing. The chamber is sealed and filled with an inert gas, such as helium, argon or nitrogen in order to protect the shaped charge liner from corrosion during operation of the platform.

The shaped charge case is fluidly connected to a conduit which delivers a low viscosity, high velocity explosive material into the shaped charge case immediately prior to severing the tubular member. The section of the tubular member carrying the shaped charge case and cutter housing is prefabricated at a production facility and is incorporated into the member during deployment at an offshore location. The shaped charge case remains unloaded during the useful life of the structure or platform, with the explosive material being delivered through strategically placed conduits when the platform needs to be removed and the pile or other tubular member severed.

The conduits are fluidly connected to the shaped charge case and deliver the explosive material to an apex of the case to allow detonation of the explosive material from the surface. Following detonation of the device in a pile, for example, a high velocity jet is formed from the collapsed liner that cuts the pile below the mudline, allowing removal of the upper portion of the pile, while the lower portion of the pile remains buried below the mudline. The device can be used similarly for cutting caissons below the mudline, jacket members at any level in the water column, or deck members above the water line.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Turning now to the drawings in more detail, numeral 10 designates a section of a tubing having a shaped charge housing 12 fixedly secured therein. The section of the piling 10 is comprised of a tubular member made of material normally used in the construction of offshore platforms, for example steel types and grades referenced in API-RP-2A, or casing used in oil, gas, or other drilling applications, that is adapted to form a part of the overall structure 14. The structure 14 can be a pile supporting a platform, a conductor, a casing, or a caisson, depending on a particular application.

Figure 1:
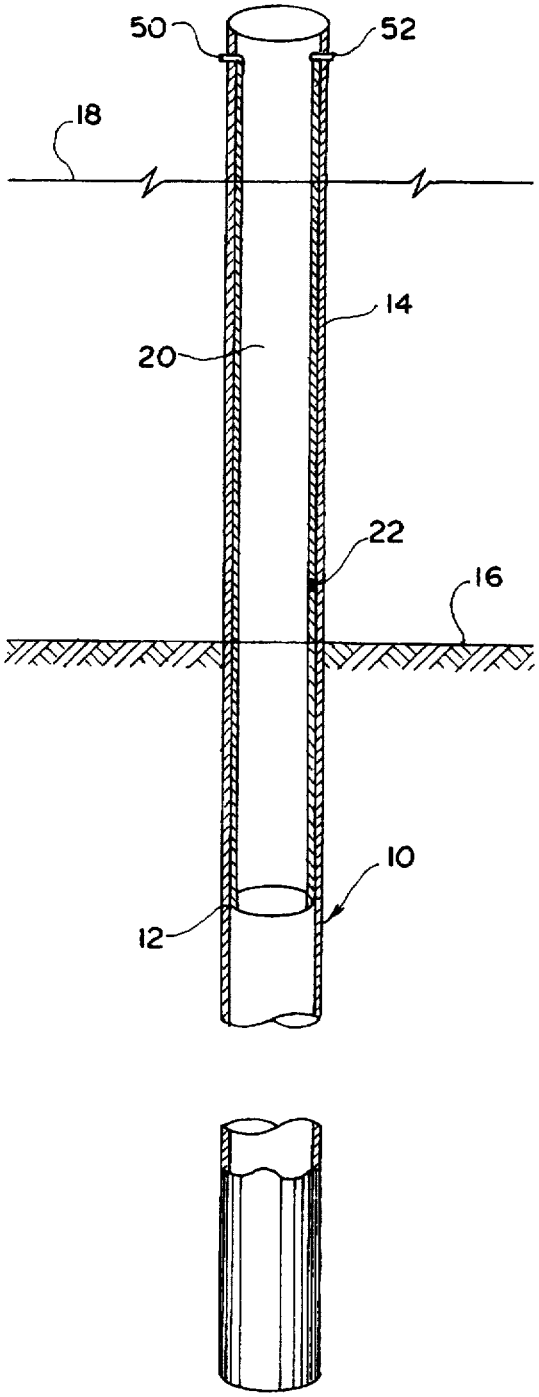
FIG. 1 is a schematic view of the device of the present invention deployed at a target depth below the mudline.

As can be seen in FIG. 1, the body 10 extends below the mudline 16, with the severing device 12 located at least 15 feet below the mudline. The pile 14 extends above the water line 18 to a distance sufficient for supporting a drilling or production platform.

Figure 2:
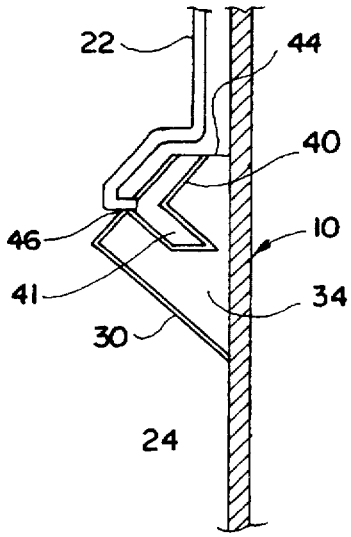
FIG. 2 is a detail schematic view of the first embodiment of the device in accordance with the present invention.
Figure 3:
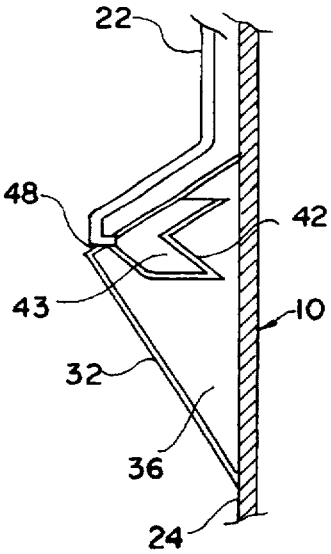
FIG. 3 is a detail schematic view illustrating the second embodiment of the device in accordance with the present invention.

A pair of hoses 20 and 22 are fixedly attached to the device 12 in a manner better seen in FIGS. 2 and 3. The tubular body 10 is pre-fabricated to carry a shaped charge housing 30 (FIG. 2) or 32 (FIG. 3) fixedly attached to an interior wall 24 of the pile section 10. Each of the housings 30, 32 is annularly shaped to extend about the inner circumference of the pile section 10, as can be better seen in FIG. 1. The cross-section of the housing 32 can be of any desired form, such as triangular cross-section, as shown in FIG. 3 or a section having triangularly truncated top of a housing 40, as shown in FIG. 2.

A watertight, airtight chamber 34, 36 is formed in the housings 30,32 respectively. Since the housing 30, 32 are welded or otherwise fixedly attached to the wall 24, the chambers 34 and 36 are sealed from the environment. The air inside the chambers 34 and 36 is displaced by an inert gas, such as helium, argon, or nitrogen, to retard corrosion inside the housing during the operational life of the platform. This process can be accomplished by pumping the inert gas through temporary openings or connections (not shown) formed in the housings that are permanently sealed once the air is completely displaced in the chambers 34 and 36.

The housing 30, 32 can be welded to the inside of a pile or to the outside of a caisson, that is where no restriction to diameter prevents additional elements to be carried by the exterior wall of the tubular member.

Mounted within the chambers 34, 36 are shaped charge cases 41, 43 which can be chevron-shaped, or V-shaped to conform to the truncated top wall 44 of the housing 30. The liners 40, 42 can be made of nickel, copper or other materials; they can be extruded, rolled, machined or formed, as desired. Of course, other materials and manufacturing methods can be employed to form the shaped charge cases 41 and 43, as well as the liners 40, 42. Other liner shapes, for example, W-shapes, channel shapes, semi-circular shapes determined by experiment or hydrocode analysis can be used.

A pre-determined stand-off distance is maintained between the leading edge of the shaped charge liner and the wall of the pile or other tubular member. The stand-off distance depends on the thickness, composition and strength of the tubular member, the angle of the apex of the liner, the composition of the liner, the shape of the housing and case, and the composition properties of the explosive. The shape of the housing can be circular or elliptical, depending on the orientation of the pile driven into the ocean bottom.

The liner 40, 42 can be installed closer to the interior wall 24 of the pile section 10. As a result, the diameter of this section can be made smaller, if necessary.

Openings 46, 48 are made at the apex of the shaped charge cases 41, 43, respectively. The openings 46 and 48 are adapted to connect to one end of the hose 22 that is designed to carry explosive material to the case, as will be described in more detail hereinafter. Suitable fittings (not shown) are provided about the openings 46 and 48 to accommodate the end of the hose 22 in a watertight, airtight manner. The hoses 22 are bent to follow the shape of the upper part of the housings 30, 32, and to extend in a substantially parallel relationship to the wall 24 to a distance above the water line 18.

A pair of openings 50, 52 are formed on diametrically opposite sides of the pile 14 to accommodate connectors, such as tubing coupling with the plug, or similar means (not shown) below the top of the pile 14. Hoses 20 forms an explosive loading hose during operation, while the hoses 20 and 22 act as detonating cord during an explosive operation.

When the pile 14 is installed at a pre-determined site, the pile sections are assembled together, with one of the sections being the section 10 that includes the housing 30 or 32. If the final pile section contains one of the housings 30,32, which would be the case in shallow waters, the last installation step is to displace the air in the hoses 20,22 and in the shaped charge cases 41, 43. The air is displaced with an inert gas, after which the hose and tubing plugs are sealed.

If the installation requires additional pile sections to be added above the tubing 10, as would be the case in deeper waters, the hose connections between the pile sections must be mated. The hose or tubing connections can be terminated inside the pile or on the outside of the pile through openings drilled in the pile. It is preferred that the hoses 20, 22 terminate inside the pile to prevent corrosion and damage to the hoses during the life of the platform. Terminating the hose connections outside the pile 14 would allow the charge to be loaded and detonated without removing the platform deck (which rests on and is connected to the top of the piles). This type of application can be suitable for shallow water platforms.

If the platform deck that rests on the pile 14 is to be removed, it is disconnected from the pile 14 in a conventional manner. Alternatively, if the pile 14 is equipped with a coupling connector for the hoses 20 and 22, as shown in FIG. 1, the platform deck may remain in place. The couplings 50 and 52 are then connected to a pump (not shown) which delivers a low viscosity, high velocity explosive into the hose 20 and into the shaped charge case 41 or 43.

After the shape charge case is filled with an explosive material, continuous pumping of the explosive through the hose 20 will cause the explosive material to move into the hose 22 and ascend through the tubing 22 until it reaches the coupling 52. To eliminate air voids in the system, the explosive is circulated through the system of delivery hose 20, charge cases 41, 43 and out through the hose 22. The circulation continues until a quantity equal to several volumes of the hoses 20, 22 and shaped charge cases 41, or 43 has been pumped.

Subsequently, detonators (not shown) are attached to hose ends 50, 52 above the surface of water and a detonating signal is sent to the explosive charge case 41 or 43. The shaped charges 41 and 43 produce a highly concentrated, narrow ribbon-shaped planar jet composed of the collapsed liners 40, 42 to move in the direction of the pile wall 24, severing the wall 24 at a location opposite the liner 40, 42. The resultant cut is relatively clean, with no jagged edges in the pile section, and insignificant deformation of the removed pile.

It is envisioned that soil inside the pile 14 would dampen the shock of the explosion protecting the marine life around the platform site.

When the cutting operation is complete, the upper section of the pile 14 can be safely removed from the platform site, while the lower section, more than 15 feet below the mudline will remain buried below the ocean floor.

The present invention allows to create a shaped charge for each specific cutting operation with due consideration to the diameter of the tubular member, thickness of the wall and the shape of the tubular member. Depending on the specific environment, the housing 30, 32 can be annular, elliptical, etc. During prefabrication of the tubular section 10, it is also possible to maintain the required stand-off distance to form an efficient gap and maximize the charge efficiency, while minimizing the weight of the charge required for cutting. It is envisioned that for conventional piles of an offshore platform, where all piles are to be removed, the sections 10 of the cutter assembly can be attached to each pile and driven to the proper depth where cutting is to be performed. For skirt piles, an inside cutter can be fitted and the hose conduit 20, 22 that terminates a few feet below the top of the pile can be connected by divers to allow delivery of the explosive into the shaped charge case 41, 43.

For large diameter caissons (8–14 feet in diameter), a series of cutters with an individual explosive weight of under five pounds each can be fitted on the outside perimeter of the caisson. Each cutter would have at least one loading and return hose. Alternate cutting assemblies can be detonated one at a time, separately, or the cutters could be detonated simultaneously if the explosive charge is under fifty pounds.

Under certain circumstances, current regulations allow to perform a partial removal of the platform. In such a case, the upper portion of the jacket is removed, and the remainder of the jacket is left in place. Under such conditions, an internally positioned cutting assembly can be fitted into the internal wall of each pile, and an external cutting assembly can be fitted on each jacket leg. The external assembly can be fitted a minimum of 85 feet below the water surface, in compliance with the current minimum requirements, while the internal cutting assembly can be positioned 1–2 feet below the external assembly. During such application, both cuts are made with the upper portion of the jacket remaining stable for rigging up and lifting from the lower portion of the jacket.

When deep water platforms are to be removed, an inside cutting assembly can be employed. It is possible to use remotely operated detonating devices for severing the pile, after the loading hoses have been connected.

The device of the present invention provides a consistent, reliable cost effective operation resulting in a substantially smooth cutting surface. Position of the charge housing during a prefabrication process will take advantage of developments in the field of explosives, incorporating newer, more efficient explosive materials that exist at the time when the pile needs to be cut. The present invention allows to design the shaped charge with closer charge weight tolerances and take advantage of new hydrocode analysis and dynamic modeling of the cutting jet with variations in the components of the cutting assembly.

The charge weight can be five pounds or less for smaller diameter piles eliminating the need for governmental permits. Even if the five pound limit is exceeded when cutting large diameter piles and caissons, the current fifty pound limit is not expected to be exceeded. An additional advantage of the device is that no jetting of soil and debris from the interior or exterior of the pile is required. Attenuation of the pressure waves through the soil from the explosive will be maximized because the charge is designed to be deployed at least 15 feet below the mudline both inside and outside of the pile.

Since the housing containing the explosive charge case and liner is sealed from the environment by the initial welding, the liner will not corrode or disintegrate during the years the platform is in operation. In an alternative embodiment of the housing, most of the chambers 34, 36 can be filled with high density materials such as sand or cement, with the exception of the area between the shaped charge liner and the wall of the tubular member. Such confinement increases the efficiency of the shaped charge. The shaped charge case remains unloaded during the useful life of the structure or platform, posing no hazard to safety nor to the structural integrity of the platform. The shaped charge liner can be made of metal, ceramics, or a composite material, with the liner being fully protected by the surrounding housing.

In an alternative embodiment, it is envisioned that a series of hoses can be equally spaced around the outer perimeter of the shaped charge, with half of the hoses being connected to the pump for filling the explosive material space, with the other half being connected to a return line hose.

Many changes and modifications can be made in the design of the present invention without departing from the spirit thereof I, therefore, pray that my rights to the present invention be limited only by the scope of the appended claims.

I claim:

1. An apparatus for severing tubular members, comprising:

a cylindrical body;

an annular housing fixedly attached to a wall of said body, said housing having an inner wall that defines an interior chamber;

a hollow shaped charge case fixedly secured on the inner wall of the housing within said interior chamber, said shaped charge case being adapted to receive an explosive material therein; and a conduit means for delivering an explosive material into said shaped charge case immediately prior to severing the tubular member.

2. The apparatus of claim 1, wherein said cylindrical body is adapted to form at least one section of said tubular member.

3. The apparatus of claim 1, wherein said housing is attached inside of said body.

4. The apparatus of claim 1, wherein said housing is attached to an exterior wall of said body.

5. The apparatus of claim 1, wherein said interior chamber is filled with an inert gas.

6. The apparatus of claim 5, wherein said inert gas is selected from a group consisting of helium, argon and nitrogen.

7. The apparatus of claim 1, wherein said conduit means is mounted in fluid communication with said shaped charge case.

8. An apparatus for severing a tubular member having at least two tubular sections, the apparatus comprising:

a cylindrical body adapted to form one of said at least two sections of the tubular member;

an annular housing fixedly attached to an interior wall of said body, said housing having an inner wall that defines a closed chamber, said chamber being filled with an inert gas;

a hollow shaped charge case fixedly secured on the inner wall of the housing in said closed chamber, said shaped charge case being adapted to receive an explosive material therein;

a conduit means mounted in fluid communication with said shaped charge case for delivering the explosive material into said shaped charge case immediately prior to severing the tubular member.

9. The apparatus of claim 8, wherein said inert gas is selected from a group consisting of helium, argon and oxygen.

10. An apparatus for severing a tubular member having at least two tubular sections, the apparatus comprising:

a cylindrical body adapted to form one of said at least two sections of the tubular body;

an annular housing fixedly attached to an exterior wall of said body, said housing defining a closed chamber;

a hollow shaped charge case fixedly secured on an inner wall of the housing within said interior chamber, said shaped charge case being adapted to receive an explosive material therein; and a conduit means mounted in fluid communication with said shaped charge case, said conduit means being adapted for delivering an explosive material into said shaped charge case immediately prior to severing a tubular member.

11. The apparatus of claim 10, wherein said closed chamber is filled with an inert gas.

12. The apparatus of claim 11, wherein said inert gas is selected from a group consisting of helium, argon and nitrogen.

13. The apparatus of claim 10, wherein a predetermined stand-off distance is maintained between a wall of the cylindrical body and a leading edge of the shaped charge liner.

14. An apparatus for severing, below a mudline, an offshore platform pile having a plurality of pile sections, the apparatus comprising:

a cylindrical body adapted to form one of said pile sections;

an annular housing fixedly attached to a wall of said body, said housing having an inner wall that defines a closed interior chamber;

a hollow shaped charge case fixedly secured on the inner wall of the housing inside said interior chamber, said shaped charge case being adapted to receive an explosive material therein; and a conduit means fluidly connected to said shaped charge case for delivering an explosive material into said shaped charge case immediately prior to severing a tubular member.

15. The apparatus of claim 14, wherein said shaped charge case has a leading edge facing the wall of said body, and wherein a pre-determined stand-off distance is retained between the leading edge of the shaped charge case and said wall of the cylindrical body.

* * * * *